US005164042A

United States Patent [19]

Larsén et al.

[11] Patent Number: 5,164,042

[45] Date of Patent: Nov. 17, 1992

[54] METHOD AND PLANT FOR PRODUCING HIGH-YIELD PULP FROM PULP CHIP MATERIAL CONTAINING LIGNOCELLULOSE

[75] Inventors: Hans Larsén, Bromma; Leif Klinga, Österskär, both of Sweden

[73] Assignee: Celleco AB, Stockholm, Sweden

[21] Appl. No.: 784,735

[22] PCT Filed: Nov. 4, 1988

[86] PCT No.: PCT/SE88/00596

§ 371 Date: Apr. 26, 1990

§ 102(e) Date: Apr. 26, 1990

[87] PCT Pub. No.: WO89/04394

PCT Pub. Date: May 18, 1989

Related U.S. Application Data

[63] Continuation of Ser. No. 474,021, Apr. 26, 1990.

[30] Foreign Application Priority Data

Nov. 4, 1987 [SE] Sweden ..... 8704310

[51] Int. Cl.[5] ..... D21B 1/16

[52] U.S. Cl. ..... 162/25; 162/17; 162/19; 162/52; 162/57; 162/68; 162/242; 162/243; 162/246; 162/248; 162/249; 162/261

[58] Field of Search ..... 162/17-19, 162/25, 26, 52, 57, 68, 241, 242, 243, 248, 249, 261, 246

[56] References Cited

U.S. PATENT DOCUMENTS

| | | | |
|---|---|---|---|
| 2,858,213 | 10/1958 | Durant et al. | 162/17 |
| 3,165,436 | 1/1965 | Bennett et al. | 162/68 |
| 3,303,088 | 2/1967 | Gessner | 162/19 |
| 3,525,665 | 8/1970 | Gessner | 162/19 |
| 4,187,141 | 2/1980 | Ahrel | 162/78 |
| 4,190,490 | 2/1980 | Tomlinson | 162/19 |
| 4,767,499 | 8/1988 | Simonson | 162/25 |

FOREIGN PATENT DOCUMENTS

| | | |
|---|---|---|
| 194981 | 9/1986 | European Pat. Off. . |
| 157050 | 11/1956 | Sweden . |

*Primary Examiner*—Peter Chin

*Attorney, Agent, or Firm*—Davis, Hoxie, Faithfull & Hapgood

[57] ABSTRACT

In a method of producing high-yield pulp from pulp chip material containing lignocellulose the material is treated with steam in a steam treating station (1) for driving air out of the material and heating the latter. Heat treated material is mixed in a mixing station (8) with a liquid containing chemicals. The mixture of steam treated material and said liquid is transferred from the mixing station to an impregnation station (25) for impregnating the material by means of said chemicals. Impregnated material is supplied to a refining station (36) for refining the material. According to the invention the steam treated material is mixed with said liquid in proportions, such that the created mixture of material and liquid leaving the mixing station (8) assumes a flowing pumpable consistency. Further, said flowing mixture is pumped from the mixing station (8) to the impregnation station (25).

6 Claims, 1 Drawing Sheet

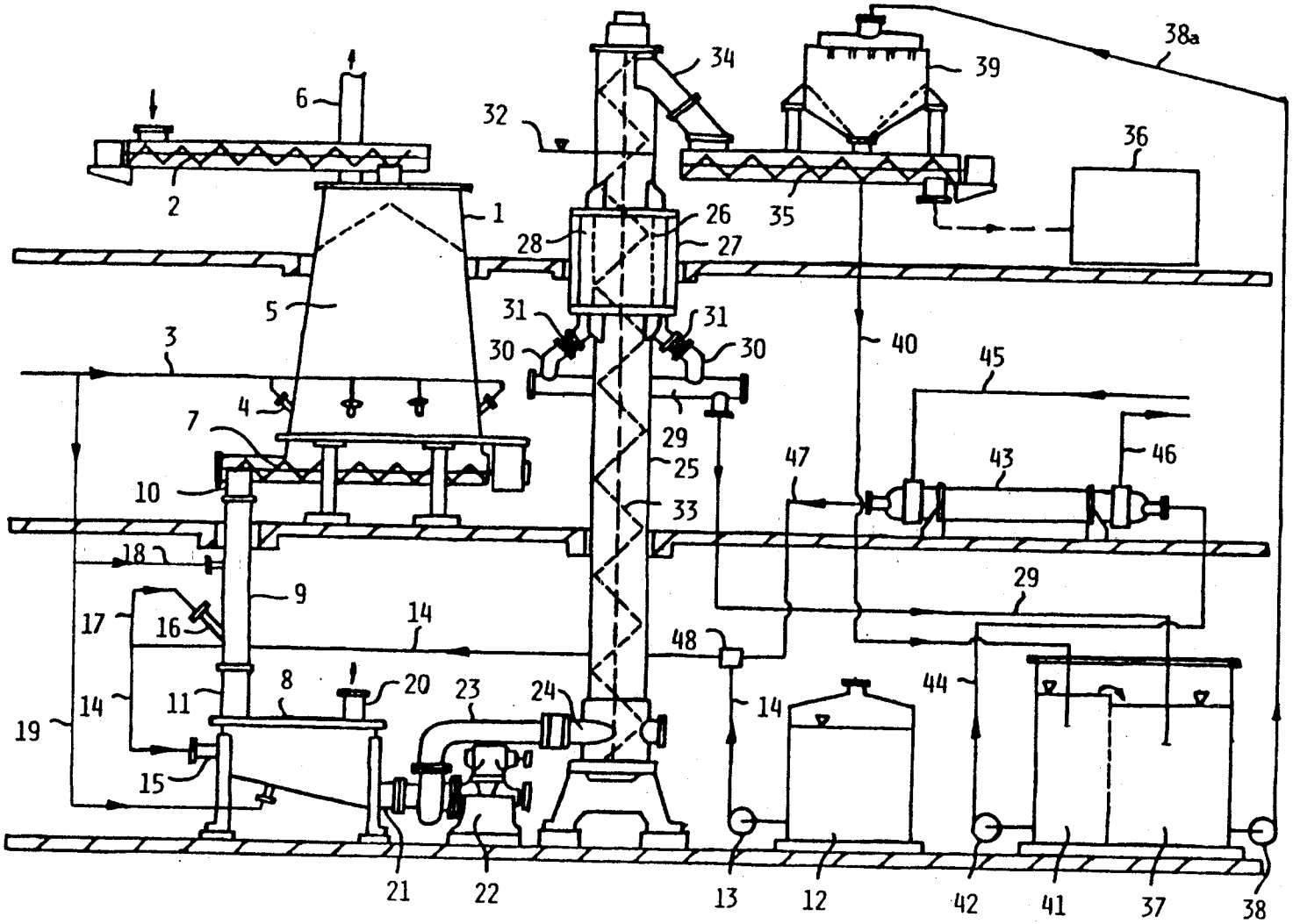
38a
36
39
34
32
35
26
27
28
1
6
2
5
3
4
7
10
18
17
16
9
8
11
15
19
14
20
23
24
22
21
13
12
42
41
37
38
44
48
47
40
45
46
43
29
25
33
30
31

METHOD AND PLANT FOR PRODUCING HIGH-YIELD PULP FROM PULP CHIP MATERIAL CONTAINING LIGNOCELLULOSE

This is a continuation of copending application Ser. No. 07/474,021 filed on Apr. 26, 1990 and International Application PCT/SE88/00596 filed on Nov. 4, 1988 and which designated the U.S.

The present invention relates to a method of producing high-yield pulp from pulp chip material containing lignocellulose, the material being steam treated in a steam treating station for driving air out of the material and heating of the latter, steam treated material being mixed in a mixing station with liquid containing chemicals, the mixture of steam treated material and said liquid being transferred from the mixing station to an impregnation station for impregnating the material by means of said chemicals, and impregnated material being supplied to a refining station for refining the material.

In a conventional plant for producing high-yield pulp the impregnation station comprises an impregnation container, to which the steam treated chip material is supplied by means of a specially formed feed screw, which is arranged to compress the chip material strongly during feeding of the latter into the lower part of the impregnation container. In the impregnation container, which contains a solution of said chemicals, e.g. sodium sulphite, sodium bisulphite, caustic soda and/or a mixture of said chemicals, the chip material is expanded so that chemical solution is sucked into and distributed in the latter. The chip material in the impregnation container rises in this during a period of time, which is adjusted so that the chip material will be saturated with chemical solution. Saturated chip material is discharged through an outlet in the upper part of the impregnation container and is conveyed via a reaction vessel to the refining station. Fresh chemical solution is supplied to the lower part of the impregnation container in a corresponding amount per time unit as used chemical solution is discharged from the impregnation container together with discharged saturated chip material.

The above described impregnation of the chip material by means of a chemical solution, the chip material being reacted on by the chemicals, provides the advantage that the mechanical separation of the fibres of the chip material is facilitated and improved when refining.

However, in this conventional plant the chemical solution is mixed relatively unevenly with the chip material. To ensures that the chip material as completely as possible reacts with the chemicals, a chemical solution of substantially higher chemical concentration, e.g. 10%, than is theoretically necessary, usually 0.5%, is maintained in the impregnation container. The treatment of the chip material with said high chemical concentration results in the drawback that the energy consumption for refining such treated chip material into pulp will be substantially higher than the refining of optimally chemically treated chip material would require. The high chemical concentration, thus required for conventional production of high-yield pulp, also results in the drawback that the printability properties of paper produced by such pulp will be deteriorated. In addition, the use of such solution of high chemical concentration will mean greater difficulties in and increased costs for cleaning of excess liquid that results from production of paper from such pulp.

Because of the above described compression of the chip material during feeding of the latter into the impregnation container by means of said feed screw, the chip material is worked on mechanically very strongly. This results in the drawback that the strength of the pulp and the paper produced therewith will be detrimentally affected.

In another known plant for producing high-yield pulp, according to SE 157 050, cold chemical liquid is mixed with hot steam treated chip material, existing steam bubbles in the pores and cavities of the chip material being thereby condensed so that liquid is sucked into the latter. The result will be that the liquid is distributed evenly in the chip material. This known plant does not utilize any plug screw of the kind above described, but a screw conveyor takes care of the transportation of liquid treated chip material through an impregnation station.

However, the known plant according to SE 157 050 also has the drawback that the chip material has to be treated with a liquid of a substantially higher chemical concentration than is theoretically necessary, since liquid can only be added in such limited amounts that the mixture of chip material and liquid will not have a flowing consistency, which would make impossible transportation of the chip material by means of said screw conveyor.

The object of the present invention is to remove the above described drawbacks in conventional plants for producing high-yield pulp by providing a new method, which allows low energy consumption for the refining, better printability properties of the paper produced from such pulp, decreased costs for cleaning of excess liquid and increased strength in the pulp and the paper produced therewith. A further object of the present invention is to provide a plant for accomplishing the method.

These objects are obtained by means of a method of the kind initially stated, which according to the invention is characterized in that the steam treated material is mixed with said liquid in proportions, such that the created mixture of material and liquid, which leaves the mixing station, assumes a flowing pumpable consistency, and that said flowing mixture is pumped from the mixing station to the impregnation station.

Thus, the chemical-containing liquid can be allowed to have the same low chemical concentration, e.g. 0.5%, that is desired in the finished impregnated chip material.

The invention also relates to a new plant for producing high-yield pulp from pulp chip material containing lignocellulose, comprising a steaming container for treating the material by means of steam for driving air out of the material and heating the latter, a device for mixing steam treated material with a liquid containing chemicals, a container for impregnating the material with said chemicals, and a device for refining impregnated material. The new plant is mainly characterized in that said mixing device comprises a separate mixing container, which through a connection conduit is connected to a steaming container and which through a further connection conduit is connected to the impregnation container, and an inlet in the mixing container for supplying said liquid containing chemicals, and that the pump is arranged in said further connection conduit between the mixing container and the impregnation container for pumping the mixture of liquid and material from the mixing container into the impregnation container. Hereby, a simple plant adapted to its purpose is obtained for accomplishing the method according to the invention.

Preferably the plant comprises a device for separating liquid from the mixture in the impregnation container, a liquid conduit arranged for conducting separated liquid from the separation device to the mixing container, and a cooling device for cooling separated liquid, which flows through said liquid conduit. Suitably, means are adapted for discharging separated liquid through a liquid outlet in the impregnation container in such a way, that a free liquid surface is created in the impregnation container, and a conveyor device is arranged for lifting the material out of the mixture in the impregnation container and discharging the material through an upper outlet in the impregnation container situated above said free liquid surface.

According to an embodiment of the plant according to the invention the impregnation container has a substantially circular cylindrical shape with a substantially vertical axial extension, the separation device comprises a strainer means, and the conveyor device comprises a feed screw extending centrally in the impregnation container from its upper outlet down into the mixture and past the strainer means.

Advantageously, the impregnation container is provided with an inlet arranged with a tangential direction into the impregnation container, such that during operation the mixture of material and liquid flowing into the impregnation container is brought into rotation and is guided upwards in the impregnation container when contacting the feed screw.

Suitably, the strainer means has a circular cylindrical shape and is arranged so that it surrounds the feed screw and is coaxial with the latter, the diameter of the strainer means being dimensioned, such that during operation the feed screw cleans the strainer means from substances that have been caught in the strainer passages of the strainer means.

The invention will be explained more closely in the following with reference to the accompanying drawing, which schematically shows a preferred embodiment of a plant according to the invention.

In the plant shown in the drawing cleaned chip material comes into a steaming container 1 via a feed device 2 comprising one or more feed screws. Steam under atmospheric pressure and close to 100° C. is supplied to the steaming container 1 via a steam conduit 3 and a number of steam inlets 4, which are arranged at the lower part of the steaming container. The steam coming into the steaming container 1 flows upwards through the chip material 5, thus heating and driving air out of the latter. Excess steam and purged air leave the steaming container 1 through an outlet 6. Steam treated material is discharged by means of a discharge device 7, which comprises one or more feed screws and which is arranged in the bottom part of the steaming container. The discharge device 7 is controllable for discharging steam treated material in a desired flow.

Steam treated material is fed by means of the force of gravity from the steaming container 1 to the mixing container 8 via a vertical connection conduit 9, one end of which is connected to a downwards directed outlet 10 in the steaming container 1 and the other end of which is connected to an upwards directed inlet 11 in the mixing container 8. Cold fresh liquid of about room temperature and containing about 0.5% chemicals is fed by means of a dosage pump 13 from a container 12 via a conduit 14 to an inlet 15 in the mixing container 8. Cold liquid is mixed with hot steam treated material in the mixing container 8, steam bubbles in the pores and cavities of the material thereby being condensed and liquid thereby being sucked into the latter. A smaller part of the liquid is also supplied to an inlet 16 in the connection conduit 9 via a conduit 17. To ensure that the material in the mixing container 8 is hot enough, steam is also supplied to the connection conduit 9 and directly to the mixing container through steam conduits 18 and 19, respectively. Excess steam leaves the mixing container 8 through an upper outlet 20.

The mixture of liquid and material leaves the mixing container 8 through an outlet 21 and is pumped by means of a pump 22 through a connection conduit 23 into an inlet 24 situated in the lower part of an elongated circular cylindrical impregnation container 25 having a substantially vertical axial extension. The chip material in the incoming mixture rises in the impregnation container 25 during a certain period of time, usually about 10 minutes, until the material is completely impregnated. Liquid is continuously separated from the mixture by means of a circular cylindrical strainer means 26 situated coaxially with the impregnation container 25 in an upper part of the latter.

An upper wall part 27 of the impregnation container 25 forms together with the strainer means 26 an annular space 28, in which separated liquid is collected. The space 28 is by means of partition walls divided into a plurality of sub-spaces, each of which communicates with a main conduit 29 via its respective conduit 30. Each conduit 30 is provided with an adjustable valve 31 for adjustment of the flow of the separated liquid out from the impregnation container 25, so that a free liquid surface 32 is maintained in the impregnation container 25 at a level above the strainer means 26.

When the plant is not in operation washing liquid may be supplied to the main conduit 29 and in turn be conducted into the sub-spaces by opening and closing the valves 31 in the conduits 30, so that the strainer means 26 is cleaned effectively.

Alternatively, the space 28 may be without partition walls. In that case only one adjustable valve would be needed arranged in the main conduit 29.

A conveyor device comprising a feed screw 33 extends centrally in the impregnation container 25 from an upper outlet 34 in the latter down to the inlet 24. The impregnated material is lifted by the feed screw 33 out of the strongly thickened mixture at the region of the straining means 26, so that excess liquid runs off the material back down into the mixture, whereafter lifted material is discharged through the upper outlet 34 and is supplied to a refining device 36 via a conveyor conduit 35.

The feed screw 33 cooperates with the mixture flowing into the impregnation container 25 by its inlet 24 being arranged with a tangential direction into the impregnation container 25, such that inflowing mixture is brought into rotation and when contacting the feed screw 33 is guided upwards in the impregnation container 25. That is, if the feed screw 33 forms a screw turning clockwise in a direction upwards from the bottom of the impregnation container, the inlet 24 has a tangential direction, such that the inflowing mixture is brought into clockwise rotation seen in the same direction, and vice versa.

The strainer means 26 has a diameter, which moderately exceeds the diameter of the feed screw 33. During the rotation of the feed screw 33, the feed screw 33 therefore cleans the straining means 26 from substances that have been caught in the strainer passages of the strainer means 26.

Through the main conduit 29 separated liquid is supplied to a container 37, from which the liquid by means of a pump 38 is pumped through a conduit 38*a* to a strainer device 39 situated above the conveyor device 35. The strainer device 39 cleans the liquid of fine material residues, which have passed through the strainer means 26, and supplies the material residues to the conveyor device 35, while the cleaned liquid through a conduit 40 is supplied to a container 41. From the container 41 the liquid by means of a pump 42 is pumped to a cooler 43 via a conduit 44. The cooler 43 consists of a tube heat exchanger, in which cooling medium is circulated through conduits 45 and 46. Cooled liquid is conducted from the cooler 43 through a conduit 47 and is supplied to the conduit 14 via a mixing unit 48, in which cooled liquid is mixed with fresh liquid from the container 12, after which the mixture of cooled separated liquid and fresh liquid is supplied to the mixing container 8.

We claim:

1. In a plant for producing high-yield pulp from pulp chip material containing lignocellulose, said plant comprising a steaming container for treating pulp chip material with steam to drive out air and heat the material, means for mixing steam heated chip material with a chemicals-containing liquid, a container for impregnating said material with said chemicals and a device for refining the impregnated material, the improvement wherein the pulp chip material containing lignocellulose has not been dewatered by substantial compression and wherein said mixing device comprises a separate mixing container and which includes a first conduit connecting said steaming container to said mixing container, a second conduit connecting said mixing container to said impregnation container, an inlet in said mixing container for supplying said chemicals-containing liquid and a pump situated in said second conduit for pumping the mixture of liquid and material from the mixing container into the impregnation container and which further includes a device in the impregnation container for separating liquid from the mixture therein, a third conduit for conducting separated liquid from said separation device to the mixing container and a cooling device for cooling of separated liquid flowing through said third conduit.

2. A plant according to claim 1, further comprising means for discharging separated liquid through a liquid outlet in the impregnation container in a way such that a free liquid surface is created in the impregnation container, and wherein a conveyor device is provided for lifting the material out of the mixture in the impregnation container and discharging the material through an upper outlet in the impregnation container situated above said free liquid surface.

3. A plant according to claim 2, in which the impregnation container has a substantially circular cylindrical shape with a substantially vertical axial extension, wherein the separation device comprises a strainer means and the conveyor device comprises a feed screw, extending centrally in the impregnation container from its upper outlet down into the mixture and past the strainer means.

4. A plant according to claim 3, wherein the impregnation container is provided with an inlet for said mixture which is arranged with a tangential direction into the impregnation container, such that during operation the mixture of material and liquid flowing into the impregnation container is brought into rotation and when contacting the feed screw is guided upwards in the impregnation container.

5. A plant according to claim 3, wherein the strainer means has a circular cylindrical shape and surrounds the feed screw coaxially with the latter, the diameter of the strainer means being dimensioned such that during operation the feed screw cleans the strainer means from substances, which have become caught in the strainer passages of the strainer means.

6. In a method of producing high-yield pulp from pulp chip material containing lignocellulose in which the material is treated with steam for driving out air and heating the material, the material so treated is mixed with a chemicals-containing liquid, the mixture of steam heated chip material and liquid is transferred to an impregnation station for impregnating material with said chemicals and the impregnated material is transferred to a refining device, the improvement which comprises supplying the chemicals-containing liquid, which is at approximately room temperature, to the steam heated chip material, which material has not been dewatered by substantial compression, mixing the steam heated chip material with the liquid in proportions such that the mixture is of a flowing pumpable consistency and pumping said mixture from the mixing station to the impregnation station, which is separate from the mixing station.

* * * * *